United States Patent [19]

Moebus

[11] Patent Number: 4,587,932

[45] Date of Patent: May 13, 1986

[54] LIQUID-COOLED COMPOSITE PISTON FOR INTERNAL COMBUSTION ENGINES

[75] Inventor: Horst Moebus, Neckarsulm, Fed. Rep. of Germany

[73] Assignee: Kolbenschmidt Aktiengesellschaft, Neckarsulm, Fed. Rep. of Germany

[21] Appl. No.: 695,999

[22] Filed: Jan. 29, 1985

[30] Foreign Application Priority Data

Feb. 2, 1984 [DE] Fed. Rep. of Germany ..... 3403624

[51] Int. Cl.[4] ..... F02F 3/22; F01P 3/10

[52] U.S. Cl. ..... 123/41.35; 123/193 P; 92/186

[58] Field of Search ..... 123/41.35–41.39, 123/193 P; 92/186

[56] References Cited

U.S. PATENT DOCUMENTS 4,175,502 11/1979 Moebus ..... 123/41.35

4,368,697 1/1983 Moebus ..... 123/41.35

*Primary Examiner*—William A. Cuchlinski, Jr.

*Attorney, Agent, or Firm*—Sprung, Horn, Kramer & Woods

[57] ABSTRACT

A composite piston for internal combustion engines has an interior cooling chamber and an outer cooling passage. An annular rib protrudes from the inside surface of the upper part and that surface of the lower part which faces that annular rib. An annular flange is clamped between said rib and said surface of the lower part. A tongue which protrudes into the cooling passage is provided on that edge of said flange which faces the cooling passage. In order to minimize the temperature of that surface of the cooling passage which is near the combustion chamber and to maintain at least adjacent to the uppermost ring groove a temperature which is sufficient to prevent a wet corrosion of the piston and of the piston rings, the tongue defines a relatively narrow annular gap with that surface of the cooling passage which is near the combustion chamber so that the coolant oil is throttled as it flows through that gap.

14 Claims, 2 Drawing Figures

LIQUID-COOLED COMPOSITE PISTON FOR INTERNAL COMBUSTION ENGINES

BACKGROUND OF THE INVENTION

The invention relates to a liquid-cooled composite piston for internal combustion engines, particularly diesel engines, which piston comprises a lower part that is preferably made of an aluminum piston alloy and is forced by screws against the upper part, which is preferably made of a ferrous material. The upper part has an external cooling passage and an annular flange having a tongue which protrudes into the external cooling passage The annular flange is clamped between an annular rib, which is concentrically arranged on the inside of the upper portion, and a surface which is formed on the lower portion and faces said rib. The annular rib constitutes the radially inner boundary of the cooling passage. The cooling passage is formed in the upper portion behind the top land and at least part of the ring-carrying portion and is open toward the interfacial plane between the upper and lower parts of the piston. The annular rib surrounds a centrally disposed internal cooling chamber, which communicates with the cooling passage through radially extending coolant bores The annular rib is formed with tapped bores for the screws, and the cooling passage and the cooling chamber communicate with the system in which the coolant is circulated.

DISCUSSION OF PRIOR ART

A piston known from Published German Application No. 27 23 619 which is particularly suitable for use in internal combustion engines having a high power and/or operated with heavy oil, preferably in diesel engines for medium speeds. Cooling is effected by forced-circulation cooling or spray cooling, and the coolant oil may flow radially from the outside inwardly or in the opposite direction.

That design of the piston is based on the recognition that in composite pistons arranged for forced-circulation cooling or spray cooling and having shaker chambers of standard design, the combustion chamber recess is so shaped that the highest temperature at the piston head, amounting to above 350° C. to 400° C., occurs at the beveled outer rim of the combustion chamber recess. This is due to the configuration of the jets of fuel injected from the nozzles. AT the same time, temperatures of 240° to 270° C. may occur on the inner surface of the outer cooling passage in a region which is opposite to that region. That inner surface is contacted by the cooling oil. These temperatures will result in a development of yellow to blue temper colors on the steel surface of the upper part of the piston and lie close to or above the flash point of commercially available coolant oils for diesel engines.

The experience with such pistons in operation has confirmed the assumption that in said region of the outer cooling passage the coolant oil cokes very rapidly to form an insulating oil coke layer, which reduces the cooling action with the result that that surface of the cooling passage which is near the combustion chamber assumes a much higher temperature so that the strength of the piston material is weakened. Additionally, the creep resistance is increased. It has often been observed that such effects may result in permanent deformation.

These disadvantages can be avoided by the provision of an annular flange, which is clamped between the upper and lower parts of the piston, and of a tongue provided on said flange which protrudes into the outer cooling passage and constitutes an oil-guiding ring which causes the cooling oil that has entered the cooling passage to flow along the periphery of said passage. In that case, the cooling action is improved because the dwell time of the coolant oil is increased, its velocity relative to the surface of the piston material is increased and the laminar boundary layer is reduced or eliminated by the turbulence in the cooling passage. It must be borne in mind, however, that the piston and the piston ring may be subject to wet corrosion unless a temperature of about 150° C. is maintained at least adjacent to the uppermost piston groove in order to avoid a temperature drop below the dew point temperature of the sulfurous acid which is formed by condensation from the $SO_3$ produced by the combustion of high-sulfur fuel. It has been found that in the arrangement described the coolant oil usually does not absorb heat in a quantity which is sufficient to maintain said temperature at least adjacent to the uppermost piston ring groove.

SUMMARY OF INVENTION

For this reason, it is an object of the present invention so to provide a piston of the kind described first hereinbefore wherein the temperature of that surface of the outer cooling passage which is near the combustion chamber is reduced to a minimum, the temperature adjacent to the uppermost ring groove is sufficient to prevent a wet corrosion of the piston and of the piston rings, and that both requirements are met at a coolant flow rate which is as low as possible.

This object is accomplished in accordance with the invention in that the tongue of the oil-guiding ring and that surface of the cooling passage which is near the combustion chamber define between them a relatively narrow annular gap. The coolant oil is throttled as it flows through the annular gap and the pressure of the coolant oil is thus reduced whereas its velocity of flow is substantially increased so that heat at a much lower rate than in the prior art is dissipated from that surface of the cooling passage which is near the combustion chamber through the relatively thin film of coolant oil and, as a result, a much lower temperature is obtained in that region. From the annular gap, the coolant oil enters an enlarged path, in which turbulence arises. Because the coolant oil rate is reduced by the throttling and the cooling passage has a relatively large volume, the shaker action and cooling in the ring zone and particularly at the uppermost ring groove are reduced and the temperature is increased in that region by heat conduction from the top land in a downward direction so that a temperature of 140° to 160° C. is achieved in the ring groove. At such temperatures there is no wet corrosion of the piston or of the piston rings even during operation at partial load or under no load.

In accordance with a preferred further feature of the invention, the tongue may be curved outwardly so that its inner side face and that surface of the cooling passage which is near the combustion chamber define between them a relatively long annular gap and the rate at which heat is supplied to the coolant oil is further increased.

Additionally, the annular flange and the tongue can be made of different material. Specifically, the tongue can be made of a temperature-responsive bimetal or can be provided with a similarly acting control device, such as a thermostat, so that the height of the annular gap between the tongue and that surface of the cooling passage which is near the combustion chamber can be automatically increased and decreased in dependence on the rate at which heat is to be dissipated. In that case, the optimum piston temperature can be maintained constant independently of the load by a thermostat action and the flow of coolant can be shut off entirely except for pilot transfers when the engine is operating under no load and when the piston is at a low temperature.

BRIEF DESCRIPTION OF DRAWINGS The piston designed in accordance with the invention is shown by way of example in the drawings in which:

FIG. 1 is a partial longitudinal sectional elevation of a piston according to the invention; and, FIG. 2 is a view similar to FIG. 1 showing another embodiment of the invention.

DESCRIPTION OF SPECIFIC EMBODIMENTS

Figure 1:
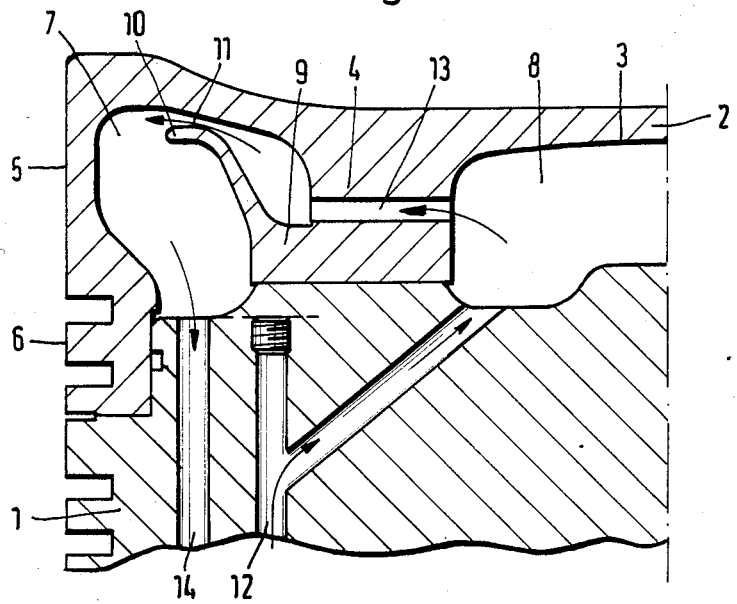

FIG. 1 shows a portion of a piston comprising a lower part 1, which is made of a eutectic aluminum-silicon alloy or nodular cast iron, and an upper part 2, which is made of steel. These two parts are interconnected by ties, not shown. A concentric annular rib 4 is disposed on the inside of the piston 3 and has a radially outer wall which constitutes the radially inner boundary surface of the cooling passage 7, which is provided between the top land 5 and the ring zone 6 and surrounds the centrally disposed cooling chamber 8. An annular flange 9 is clamped between the annular rib 4 and the opposite bearing surface of the lower part 1 of the piston. The edge of flange 9 faces the cooling passage and is provided with a tongue 10, which protrudes into the cooling passage 7 and has an inner side face, which defines a relatively narrow annular gap with that surface of the cooling passage 7 which is near the combustion chamber.

Coolant oil flows into the cooling chamber 8 through the coolant inlet 12 and flows from the cooling chamber 8 through the radial openings 13 in the annular rib 4 into the cooling passage 7. Owing to the provision of the tongue 10, coolant oil flows into the outer portion of the cooling passage 7 through the annular gap 11 between the side face of the tongue and that surface of the cooling passage which is near the combustion chamber. From that outer portion, the coolant oil flows off through the outlet opening 14.

Figure 2:
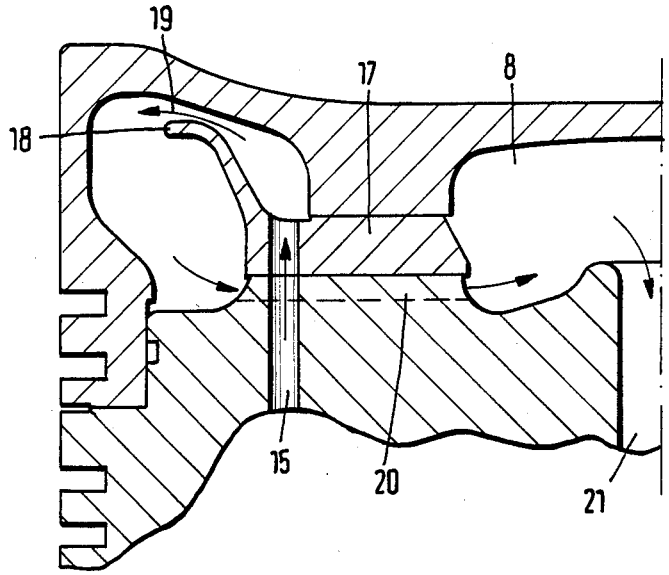

In the modified piston shown in FIG. 2, the coolant oil flows through the supply line 15 and the annular flange 17, which protrudes into the cooling passage 7 into the inner portion of the cooling passage 7. The inner side face of the outwardly curved tongue 18, which protrudes into the cooling passage, and that surface of the cooling which is near the combustion chamber, define between them an annular gap 19. The cooling oil which has emerged from the annular gap 19 flows from the cooling passage 7 into the cooling chamber 8 through the radial apertures 20 of the annular flange 17 and flows from the cooling chamber 8 through the outlet 21 into the crankcase.

The advantages afforded by the invention reside particularly in that the tongue which defines annular gap with that surface of the cooling passage which is near the combustion chamber is so designed or controlled that the upper portion of the piston is maintained at a suitable, controlled temperature.

What is claimed is:

1. In a liquid-cooled composite piston for an internal combustion engine, particularly diesel engines, which piston comprises a lower part forced against an upper part having an external cooling passage, and annular flange having a tongue which protrudes into said external cooling passage, which annular flange is clamped between an annular rib, which annular rib disposed between the inside of the upper portion and a surface which if formed on said lower portion and faces said rib, said annular rib constituting the radially inner boundary of said external passage, said external cooling passage being formed in the upper portion behind the top land and at least part of the ring-carrying portion of said piston and being open toward the interfacial plane between said upper part and said lower part of said piston, said annular rib surrounding a centrally disposed internal cooling chamber, which cooling chamber communicates with said external cooling passage through at least one radially extending coolant bores, said external cooling passage and said cooling chamber communicating with a source of coolant, the improvement wherein said tongue is curved outwardly and its inner side face and the surface of said external cooling passage which is near the combustion define between them a narrow annular gap.

2. A piston according to claim 1 wherein said tongue comprises a temperature-responsive bimetal.

3. A piston according to claim 1 wherein said tongue is adapted to be controlled by a thermostat.

4. A piston according to claim 1 wherein said lower part is made of an aluminum piston alloy or nodular cast iron.

5. A piston according to claim 4 wherein said upper part is made of a ferrous material.

6. A piston according to claim 5 wherein said upper part is made of steel.

7. A piston according to claim 1 wherein said centrally disposed internal cooling chamber is in fluid communication with source of coolant via a coolant inlet and said external cooling passage is connected to an outlet opening whereby coolant flows through said coolant inlet, thence into said external cooling passage and then out of said upper part via said outlet opening.

8. A piston according to claim 1 wherein said external cooling passage is in fluid communication with a source of coolant via a supply line which enters said external cooling passage at a point between that surface of said external cooling passage near said tongue, said centrally disposed internal cooling chamber is connected to an outlet which in turn is in fluid communication with a reservoir for coolant whereby coolant passes through said supply line and into said external cooling passage, strikes the walls of said external cooling passage near said combustion zone, passes through said annular gap, thence flows into said radially extending coolant bore, thereafter into said centrally disposed internal cooling chamber, thence out said outlet into said reservoir.

9. In an internal combustion engine having a cylinder and a piston, the improvement wherein said piston is a piston according to claim 1.

10. In an internal combustion engine having a cylinder and a piston, the improvement wherein said piston is a piston according to claim 9 wherein said centrally disposed internal cooling chamber is in fluid communication with source of coolant via a coolant inlet and said external cooling passage is connected to an outlet opening whereby coolant flows through said coolant inlet, thence into said external cooling passage and then out of said upper part via said outlet opening.

11. An internal combustion engine according to claim 10 which is a diesel engine.

12. In an internal combustion engine having a cylinder and a piston, the improvement wherein said piston is a piston according to claim 9 wherein said external cooling passage is in fluid communication with a source of coolant viea a supply line which enters said external cooling passage at a point between that surface of said external cooling passage near said tongue, said centrally disposed internal cooling chamber is connected to an outlet which in turn is in fluid communication with a reservoir for coolant whereby coolant passes through said supply line and into said external cooling passage, strikes the walls of said external cooling passage near said combustion zone, pass through said annular gap, thence flows into said radially extending coolant bore, thereafter into said centrally disposed internal cooling chamber, thence out said outlet into said reservoir.

13. An internal combustion engine according to claim 12 which is a diesel engine.

14. An internal combustion engine according to claim 9 which is a diesel engine.

* * * * *